US007718245B2

(12) United States Patent
Bhatnagar et al.

(10) Patent No.: US 7,718,245 B2
(45) **Date of Patent: *May 18, 2010**

(54) RESTRAINED BREAST PLATES, VEHICLE ARMORED PLATES AND HELMETS

(75) Inventors: Ashok Bhatnagar, Richmond, VA (US); Lori L. Wagner, Richmond, VA (US); David A. Hurst, Richmond, VA (US)

(73) Assignee: Honeywell International Inc., Morristown, NJ (US)

( * ) Notice: Subject to any disclaimer, the term of this patent is extended or adjusted under 35 U.S.C. 154(b) by 24 days.

This patent is subject to a terminal disclaimer.

(21) Appl. No.: 11/321,576

(22) Filed: Dec. 29, 2005

(65) Prior Publication Data

US 2008/0139071 A1 Jun. 12, 2008

(51) Int. Cl.

| | |
|---|---|
| ***B32B 27/02*** | (2006.01) |
| ***B32B 27/04*** | (2006.01) |
| ***B32B 27/12*** | (2006.01) |
| ***D04H 1/00*** | (2006.01) |
| ***D04H 3/05*** | (2006.01) |
| ***F41H 1/00*** | (2006.01) |
| ***F41H 1/02*** | (2006.01) |

(52) U.S. Cl. ..... 428/113; 428/68; 428/76; 428/192; 428/193; 428/194; 428/911; 428/912; 442/366; 442/367; 442/391; 442/392; 442/394; 442/398; 442/414; 2/2.5

(58) Field of Classification Search ..... 442/164, 442/169, 134, 135, 366, 394, 414; 428/911, 428/912

See application file for complete search history.

(56) References Cited

U.S. PATENT DOCUMENTS

| | | | | |
|---|---|---|---|---|
| 3,000,772 | A * | 9/1961 | Lunn | 442/208 |
| 4,543,286 | A | 9/1985 | Harpell et al. | |
| 5,330,820 | A * | 7/1994 | Li et al. | 428/113 |
| 5,545,455 | A | 8/1996 | Prevorsek et al. | 428/76 |
| 6,341,708 | B1 | 1/2002 | Palley et al. | 220/1.5 |
| 6,389,594 | B1 * | 5/2002 | Yavin | 2/2.5 |
| 6,497,966 | B2 * | 12/2002 | Cohen | 428/626 |
| 2002/0034624 | A1 * | 3/2002 | Harpell et al. | 428/298.1 |
| 2003/0199215 | A1 * | 10/2003 | Bhatnagar et al. | 442/135 |
| 2004/0016036 | A1 | 1/2004 | Bachner | |

FOREIGN PATENT DOCUMENTS

| | | | |
|---|---|---|---|
| FR | 2425487 | A * | 1/1980 |
| WO | WO 9106823 | A * | 5/1991 |

OTHER PUBLICATIONS

English Machine translation of FR 2425487 A, Printed Feb. 15, 2010.*

* cited by examiner

*Primary Examiner*—Jennifer A Chriss
(74) *Attorney, Agent, or Firm*—Erika S. Wilson

(57) ABSTRACT

Ballistic resistant fabric laminates are provided. More particularly, reinforced, delamination resistant, ballistic resistant composites are provided. The delamination resistant, ballistic resistant materials and articles may be reinforced by various techniques, including stitching one or more ballistic resistant panels with a high strength thread, melting the edges of a ballistic resistant panel to reinforce areas that may have been frayed during standard trimming procedures, wrapping one or more panels with one or more woven or non-woven fibrous wraps, and combinations of these techniques. The delamination resistant, ballistic resistant panels may further include at least one rigid plate attached thereto for improving ballistic resistance performance.

46 Claims, No Drawings

RESTRAINED BREAST PLATES, VEHICLE ARMORED PLATES AND HELMETS

BACKGROUND OF THE INVENTION

1. Field of the Invention

This invention relates to fabric laminates having excellent ballistic resistant properties. More particularly, the invention pertains to a reinforced, delamination resistant, ballistic resistant composites.

2. Description of the Related Art

Ballistic resistant articles containing high strength fibers that have excellent properties against deformable projectiles are known. Articles such as bullet resistant vests, helmets, vehicle panels and structural members of military equipment are typically made from fabrics comprising high strength fibers. High strength fibers conventionally used include polyethylene fibers, para-aramid fibers such as poly(phenylenediamine terephthalamide), graphite fibers, nylon fibers, glass fibers and the like. For many applications, such as vests or parts of vests, the fibers may be used in a woven or knitted fabric. For many of the other applications, the fibers are encapsulated or embedded in a matrix material to form either rigid or flexible fabrics.

Various ballistic resistant constructions are known that are useful for the formation of articles such as helmets, vehicle panels and vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of resistance to penetration by high speed impact from projectiles such as bullets, shells, shrapnel and the like.

For example, U.S. Pat. Nos. 4,623,574 and 4,748,064 disclose simple composite structures comprising high strength fibers embedded in an elastomeric matrix. U.S. Pat. No. 4,650,710 discloses a flexible article of manufacture comprising a plurality of flexible layers comprised of high strength, extended chain polyolefin (ECP) fibers. The fibers of the network are coated with a low modulus elastomeric material. U.S. Pat. Nos. 5,552,208 and 5,587,230 disclose an article and method for making an article comprising at least one network of high strength fibers and a matrix composition that includes a vinyl ester and diallyl phthalate. U.S. Pat. No. 6,642,159 discloses an impact resistant rigid composite having a plurality of fibrous layers which comprise a network of filaments disposed in a matrix, with elastomeric layers there between. The composite is bonded to a hard plate to increase protection against armor piercing projectiles.

It is well known that a small pointed projectile can penetrate armor by laterally displacing fibers without breaking them. Accordingly, ballistic penetration resistance is directly affected by the nature of the fiber network. For example, important factors impacting ballistic resistance properties are the tightness of a fiber weave, periodicity of cross-overs in cross-plied unidirectional composites, yarn and fiber deniers, fiber-to-fiber friction, matrix characteristics and interlaminar bond strengths.

Another important factor affecting ballistic resistance properties is the ability of the ballistic resistant material to resist delamination. In conventional composite ballistic panels, the impact of a projectile on the ballistic fabric layers passes through some of the layers while surrounding fabric layers are stressed or stretched, causing them to fray or become delaminated. This delamination may be limited to a small area, or may spread over a large area, significantly diminishing the ballistic resistance properties of the material, and reducing its ability to withstand the impact of multiple projectiles. Such delamination is also known to occur as a result of cutting sheets of ballistic resistant materials into desired shapes or sizes, causing trimmed edges to fray, and thereby compromising the stability and ballistic resistance properties of the material. Accordingly, there is a need in the art to solve each of these problems.

The present invention provides a solution to these problems. The present invention provides delamination resistant, ballistic resistant materials and articles that are reinforced by various techniques, including stitching one or more ballistic resistant panels with a high strength thread, melting the edges of a ballistic resistant panel to reinforce areas that may have been frayed during standard trimming procedures, wrapping one or more panels with one or more woven or non-woven fibrous wraps, and combinations of these techniques. The invention also provides one or more ballistic resistant panels including one or more rigid plates attached thereto for improving ballistic resistance performance, which may also be reinforced with one or more of the aforementioned techniques. The present invention presents an improvement over U.S. Pat. No. 5,545,455 which does not describe materials reinforced by melting panel edges, nor does U.S. Pat. No. 5,545,455 describe the incorporation of two fibrous wraps which are wrapped in different directions. U.S. patent further does not teach structures that incorporate outer polymer films on their panels, nor structures having rigid plates attached thereto. Articles formed from the materials described herein have been found to have excellent delamination resistance and ballistic resistance properties, which are particularly retained after being stressed by multiple impacts.

SUMMARY OF THE INVENTION

The invention provides a ballistic resistant material comprising:

a) a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) at least one layer of a polymer film attached to each of said anterior and posterior surfaces of said consolidated network of fibers;

b) a first fibrous wrap encircling the panel, said first fibrous wrap encircling at least a portion of said anterior surface, said posterior surface and at least one edge of said panel; and c) an optional second fibrous wrap encircling the panel, the second fibrous wrap encircling the first fibrous wrap in a direction transverse to the encircling direction of the first fibrous wrap.

The invention also provides a ballistic resistant material comprising:

a) a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) at least one rigid plate attached to the anterior surface of said panel;

c) a first fibrous wrap encircling the panel, said first fibrous wrap encircling at least a portion of said anterior surface, said posterior surface and at least one edge of said panel; and d) an optional second fibrous wrap encircling the panel, the second fibrous wrap encircling the first fibrous wrap in a direction transverse to the encircling direction of the first fibrous wrap.

The invention further provides a method of producing a ballistic resistant material comprising:

a) forming at least one panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) at least one layer of a polymer film attached to each of said anterior and posterior surfaces of said consolidated network of fibers;

b) molding the panel into an article;

c) encircling a first fibrous wrap around the molded panel, said first fibrous wrap encircling at least a portion of said anterior surface, said posterior surface and at least one edge of said panel; and d) optionally encircling a second fibrous wrap around the molded panel, the second fibrous wrap encircling the first fibrous wrap in a direction transverse to the encircling direction of the first fibrous wrap.

The invention still further provides a method of producing a ballistic resistant material comprising:

a) forming a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) molding the panel;

c) attaching at least one rigid plate to the anterior surface of said molded panel;

d) encircling a first fibrous wrap around the molded panel, said first fibrous wrap encircling at least a portion of said anterior surface, said posterior surface and at least one edge of said panel; and e) optionally encircling a second fibrous wrap around the molded panel, the second fibrous wrap encircling the first fibrous wrap in a direction transverse to the encircling direction of the first fibrous wrap.

The invention also provides a ballistic resistant material comprising:

a) a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers; and wherein one or more edges of said panel are reinforced by melting a portion of said panel at said one or more edges;

b) an optional first fibrous wrap encircling the panel, said first fibrous wrap encircling at least a portion of said anterior surface, said posterior surface and at least one edge of said panel; and c) an optional second fibrous wrap encircling the panel, the second fibrous wrap encircling the first fibrous wrap in a direction transverse to the encircling direction of the first fibrous wrap.

The invention further provides a ballistic resistant material comprising:

a) a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) a first fibrous wrap encircling the panel, said first fibrous wrap encircling at least a portion of said anterior surface, said posterior surface and at least one edge of said panel; and c) a second fibrous wrap encircling the panel, the second fibrous wrap encircling the first fibrous wrap in a direction transverse to the encircling direction of the first fibrous wrap.

DETAILED DESCRIPTION OF THE INVENTION

The invention provides fabric composites having superior ballistic penetration and delamination resistance. For the purposes of the invention, materials of the invention that have superior ballistic penetration resistance describe those which exhibit excellent properties against deformable projectiles.

The ballistic resistant materials, structures and articles of the invention comprise at least one ballistic resistant panel, preferably more than one panel arranged in a stack. Each ballistic resistant panel has an anterior surface, a posterior surface and one or more edges, wherein a quadrilateral shaped panel has four edges, a triangle shaped panel has three edges, etc. Each panel comprises a consolidated network of fibers, the consolidated network of fibers comprising a plurality of cross-plied fiber layers, each fiber layer comprising a plurality of fibers arranged in an array. Suitable fibers for use herein are high-strength, high tensile modulus fibers having a tenacity of about 7 g/denier or more and a tensile modulus of about 150 g/denier or more. The fibers have a matrix composition thereon, and the plurality of cross-plied fiber layers are consolidated with said matrix composition to form the consolidated network of fibers. Depending on the embodiment, the panels may further comprise at least one layer of a polymer film attached to each of said anterior and posterior surfaces of said consolidated network of fibers.

Each discrete panel of the invention comprises a single-layer, consolidated network of fibers in an elastomeric or rigid polymer composition, which elastomeric or rigid polymer composition is referred to herein as a matrix composition. The consolidated network of fibers comprises a plurality of fiber layers stacked together, each fiber layer comprising a plurality of fibers coated with said matrix composition and preferably, but not necessarily, arranged in a substantially parallel array, and said fiber layers being consolidated to form said single-layer, consolidated network. The consolidated network may also comprise a plurality of yarns that are coated with such a matrix composition, formed into a plurality of layers and consolidated into a fabric.

For the purposes of the present invention, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section.

As used herein, a "yarn" is a strand of interlocked fibers. An "array" describes an orderly arrangement of fibers or yarns, and a "parallel array" describes an orderly parallel arrangement of fibers or yarns. A fiber "layer" describes a planar arrangement of woven or non-woven fibers or yarns. As used herein, a "fabric" may relate to either a woven or non-woven material. A fiber "network" denotes a plurality of interconnected fiber or yarn layers. A fiber network can have various configurations. For example, the fibers or yarn may be formed as a felt or another woven, non-woven or knitted, or formed into a network by any other conventional technique. According to a particularly preferred consolidated network configuration, a plurality of fiber layers are combined whereby each fiber layer comprises fibers unidirectionally aligned in an array so that they are substantially parallel to each other along a common fiber direction. A "consolidated network" therefore describes a consolidated combination of fiber layers with said matrix composition. As used herein, a "single layer" structure refers to structure composed of one or more individual fiber layers that have been consolidated or united into a single unitary structure. By "consolidating" it is meant that the matrix material and each individual fiber layer are combined via drying, cooling, heating, pressure or a combination thereof, to form said single unitary layer.

As used herein, a "high-strength, high tensile modulus fiber" is one which has a preferred tenacity of at least about 7 g/denier or more, a preferred tensile modulus of at least about 150 g/denier or more, both as measured by ASTM D2256 and preferably an energy-to-break of at least about 8 J/g or more. As used herein, the term "denier" refers to the unit of linear density, equal to the mass in grams per 9000 meters of fiber or yarn. As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

Particularly suitable high-strength, high tensile modulus fiber materials include extended chain polyolefin fibers, such as highly oriented, high molecular weight polyethylene fibers, particularly ultra-high molecular weight polyethylene fibers, and ultra-high molecular weight polypropylene fibers. Also suitable are extended chain polyvinyl alcohol fibers, extended chain polyacrylonitrile fibers, para-aramid fibers, polybenzazole fibers, such as polybenzoxazole (PBO) and polybenzothiazole (PBT) fibers and liquid crystal copolyester fibers. Each of these fiber types is conventionally known in the art.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,551,296 and 5,006,390, which are also incorporated herein by reference.

The most preferred polyethylene fibers for use in the invention are polyethylene fibers sold under the trademark Spectra® from Honeywell International Inc. Spectra® fibers are well known in the art and are described, for example, in commonly owned U.S. Pat. Nos. 4,623,547 and 4,748,064 to Harpell, et al. Ounce for ounce, Spectra® high performance fiber is ten times stronger than steel, while also light enough to float on water. The fibers also possess other key properties, including resistance to impact, moisture, abrasion chemicals and puncture.

Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and are widely commercially available.

Suitable aramid (aromatic polyamide) or para-aramid fibers are commercially available and are described, for example, in U.S. Pat. No. 3,671,542. For example, useful poly(p-phenylene terephthalamide) filaments are produced commercially by Dupont corporation under the trade name of KEVLAR®. Also useful in the practice of this invention are poly(m-phenylene isophthalamide) fibers produced commercially by Dupont under the trade name NOMEX®. Suitable polybenzazole fibers for the practice of this invention are commercially available and are disclosed for example in U.S. Pat. Nos. 5,286,833, 5,296,185, 5,356,584, 5,534,205 and 6,040,050, each of which are incorporated herein by reference. Preferred polybenzazole fibers are ZYLON® brand fibers from Toyobo Co. Suitable liquid crystal copolyester fibers for the practice of this invention are commercially available and are disclosed, for example, in U.S. Pat. Nos. 3,975,487; 4,118,372 and 4,161,470, each of which is incorporated herein by reference.

The other suitable fiber types for use in the present invention include glass fibers, fibers formed from carbon, fibers formed from basalt or other minerals, M5® fibers and combinations of all the above materials, all of which are commercially available. M5® fibers are manufactured by Magellan Systems International of Richmond, Va. and are described, for example, in U.S. Pat. Nos. 5,674,969, 5,939,553, 5,945,537, and 6,040,478, each of which is incorporated herein by reference. Specifically preferred fibers include M5® fibers, polyethylene Spectral fibers, poly(p-phenylene terephthalamide) and poly(p-phenylene-2,6-benzobisoxazole) fibers. Most preferably, the fibers comprise high strength, high modulus polyethylene Spectra® fibers.

The most preferred fibers for the purposes of the invention are high-strength, high tensile modulus extended chain polyethylene fibers. As stated above, a high-strength, high tensile modulus fiber is one which has a preferred tenacity of about 7 g/denier or more, a preferred tensile modulus of about 150 g/denier or more and a preferred energy-to-break of about 8 J/g or more, each as measured by ASTM D2256. In the preferred embodiment of the invention, the tenacity of the fibers should be about 15 g/denier or more, preferably about 20 g/denier or more, more preferably about 25 g/denier or more and most preferably about 30 g/denier or more. The fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The fibers of the invention also have a preferred energy-to-break of about 15 J/g or more, more preferably about 25 J/g or more, more preferably about 30 J/g or more and most preferably have an energy-to-break of about 40 J/g or more. These combined high strength properties are obtainable by employing well known solution grown or gel fiber processes. U.S. Pat. Nos. 4,413,110, 4,440,711, 4,535,027, 4,457,985, 4,623,547, 4,650,710 and 4,748,064 generally discuss the preferred high strength, extended chain polyethylene fibers employed in the present invention.

The fabric composites of the invention may be prepared using a variety of matrix materials, including both low modulus, elastomeric matrix materials and high modulus, rigid matrix materials. The term "matrix" as used herein is well known in the art, and is used to represent a binder material, such as a polymeric binder material, that binds the fibers together after consolidation. The term "composite" refers to consolidated combinations of fibers with the matrix material. Suitable matrix materials non-exclusively include low modulus, elastomeric materials having an initial tensile modulus less than about 6,000 psi (41.3 MPa), and high modulus, rigid materials having an initial tensile modulus at least about 300,000 psi (2068 MPa), each as measured at 37° C. by ASTM D638. As used herein throughout, the term tensile modulus means the modulus of elasticity as measured by ASTM 2256 for a fiber and by ASTM D638 for a matrix material.

An elastomeric matrix composition may comprise a variety of polymeric and non-polymeric materials. The preferred elastomeric matrix composition comprises a low modulus elastomeric material. For the purposes of this invention, a low modulus elastomeric material has a tensile modulus, measured at about 6,000 psi (41.4 MPa) or less according to ASTM D638 testing procedures. Preferably, the tensile modulus of the elastomer is about 4,000 psi (27.6 MPa) or less, more preferably about 2400 psi (16.5 MPa) or less, more preferably 1200 psi (8.23 MPa) or less, and most preferably is about 500 psi (3.45 MPa) or less. The glass transition temperature (Tg) of the elastomer is preferably less than about 0° C., more preferably the less than about −40° C., and most preferably less than about −50° C. The elastomer also has an preferred elongation to break of at least about 50%, more preferably at least about 100% and most preferably has an elongation to break of at least about 300%.

A wide variety of elastomeric materials and formulations having a low modulus may be utilized as the matrix. Representative examples of suitable elastomers have their structures, properties, formulations together with crosslinking procedures summarized in the Encyclopedia of Polymer Science, Volume 5 in the section Elastomers-Synthetic (John Wiley & Sons Inc., 1964). Preferred low modulus, elastomeric matrix materials include polyethylene, cross-linked polyethylene, cholorosulfinated polyethylene, ethylene copolymers, polypropylene, propylene copolymers, polybutadiene, polyisoprene, natural rubber, ethylene-propylene copolymers, ethylene-propylene-diene terpolymers, polysulfide polymers, polyurethane elastomers, polychloroprene, plasticized polyvinylchloride using one or more plasticizers that are well known in the art (such as dioctyl phthalate), butadiene acrylonitrile elastomers, poly (isobutylene-co-isoprene), polyacrylates, polyesters, unsaturated polyesters, polyethers, fluoroelastomers, silicone elastomers, copolymers of ethylene, thermoplastic elastomers, phenolics, polybutyrals, epoxy polymers, styrenic block copolymers, such as styrene-isoprene-styrene or styrene-butadiene-styrene types, and other low modulus polymers and copolymers curable below the melting point of the fiber. Also preferred are blends of these materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type R-$(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. The most preferred matrix polymer comprises styrenic block copolymers sold under the trademark Kraton® commercially produced by Kraton Polymers.

Preferred high modulus, rigid matrix materials useful herein include materials such as a vinyl ester polymer or a styrene-butadiene block copolymer, and also mixtures of polymers such as vinyl ester and diallyl phthalate or phenol formaldehyde and polyvinyl butyral. A particularly preferred rigid matrix material for use in this invention is a thermosetting polymer, preferably soluble in carbon-carbon saturated solvents such as methyl ethyl ketone, and possessing a high tensile modulus when cured of at least about $1\times10^6$ psi (6895 MPa) as measured by ASTM D638. Particularly preferred rigid matrix materials are those described in U.S. Pat. No. 6,642,159, which is incorporated herein by reference. Optionally, a catalyst for curing the matrix resin may also be used. Suitable catalysts, by way of example, include tert-butyl perbenzoate, 2,5-dimethyl-2,5-di-2-ethylhexanoylperoxyhexane, benzoyl peroxide and combinations thereof.

Such catalysts are typically used in conjunction with thermoset matrix polymers.

The rigidity, impact and ballistic properties of the articles formed from the fabric composites of the invention are effected by the tensile modulus of the matrix polymer. For example, U.S. Pat. No. 4,623,574 discloses that fiber reinforced composites constructed with elastomeric matrices having tensile moduli less than about 6000 psi (41,300 kPa) have superior ballistic properties compared both to composites constructed with higher modulus polymers, and also compared to the same fiber structure without a matrix. However, low tensile modulus matrix polymers also yield lower rigidity composites. Further, in certain applications, particularly those where a composite must function in both anti-ballistic and structural modes, there is needed a superior combination of ballistic resistance and rigidity. Accordingly, the most appropriate type of matrix polymer to be used will vary depending on the type of article to be formed from the fabrics of the invention. In order to achieve a compromise in both properties, a suitable matrix composition may combine both low modulus and high modulus materials to form a single matrix composition. As discussed above, the formation of the high strength fibers and the consolidated networks of fibers of the invention are well known in the art, and are further described, for example, in U.S. Pat. Nos. 4,623,574, 4,748,064 and 6,642,159.

In the preferred embodiments of the invention, the ballistic resistant material comprises a stack of a plurality of discrete panels, i.e. more than one single-layer, consolidated network of fibers stacked together, one on top of another. As used herein, the term "discrete" panels describes separate and distinct panels, each of which may or may not be identical to each other, and wherein a combination of discrete panels positioned one on top of another forms a stack, which stack has a top surface, a bottom surface and one or more edges. In the preferred embodiments of the invention, the ballistic resistant material or ballistic resistant articles comprise from about 2 to about 20 discrete panels, more preferably from about 4 to about 12 and most preferably from about 4 to about 8 discrete panels. Panel dimensions may generally vary as determined by their desired usage, with individual panels in a stack preferably being substantially similar in size and shape. A small panel may have dimensions of approximately 10"×10" (25.4 cm×25.4 cm), while large panels may have dimensions of approximately 60"×120" (152.4 cm×304.8 cm). These dimensions are exemplary and not intended to be limiting. Preferably, each panel of said stack comprises a consolidated network of fibers which consolidated network of fibers comprises a plurality of cross-plied fiber layers, each fiber layer comprising a plurality of fibers arranged in a substantially parallel array. Accordingly, panel thickness will generally depend on the number of fiber layers incorporated, along with the thickness of optional outer polymer layers and the thickness of the first and second fibrous wraps.

In the preferred embodiment of the invention, the fibers preferably comprise from about 70 to about 95% by weight of the composite, more preferably from about 79 to about 91% by weight of the composite, and most preferably from about 83 to about 89% by weight of the composite, with the remaining portion of the composite being said matrix composition or a combination of said matrix and said polymer films. The matrix composition may also include fillers such as carbon black or silica, may be extended with oils, or may be vulcanized by sulfur, peroxide, metal oxide or radiation cure systems as is well known in the art. The matrix composition may further include anti-oxidant agents, such as those sold under the Irganox® trademark, commercially available from Ciba Specialty Chemicals Corporation of Switzerland, particularly Irganox® 1010 ((tetrakis-(methylene-(3,5-di-terbutyl-4-hydrocinnamate)methane)).

In general, the ballistic resistant materials of the invention are formed by arranging the high strength fibers into one or more fiber layers. Each layer may comprise an array of individual fibers or yarns. The matrix composition is preferably applied to the high strength fibers either before or after the layers are formed, then followed by consolidating the matrix material-fibers combination together to form a multilayer complex. The fibers of the invention may be coated with, impregnated with, embedded in, or otherwise applied with said matrix composition by well known techniques in the art, such as by spraying or roll coating a solution of the matrix composition onto fiber surfaces, followed by drying. Other techniques for applying the coating to the fibers may be used, including coating of the high modulus precursor (gel fiber) before the fibers are subjected to a high temperature stretching operation, either before or after removal of the solvent from the fiber (if using the conventional gel-spinning fiber forming technique). Such techniques are well known in the art.

The application of the matrix material preferably coats at least one surface of the fibers or yarns with the chosen matrix composition, preferably substantially coating or encapsulating each of the individual fibers. Following the application of the matrix material, the individual fibers in layer may or may not be bonded to each other prior to consolidation, which consolidation unites multiple fiber or yarn layers by pressing together and fusing as such coated fibers. The fabric composites of the invention preferably comprise a plurality of woven or non-woven fiber layers that are consolidated into a single layer, consolidated fiber network. In the preferred embodiment of the invention, the layers comprise non-woven fibers, each individual fiber layer of said consolidated fiber network preferably comprising fibers aligned in parallel to one another along a common fiber direction. Successive layers of such unidirectionally aligned fibers can be rotated with respect to the previous layer. Preferably, individual fiber layers of the composite are preferably cross-plied such that the fiber direction of the unidirectional fibers of each individual layer are rotated with respect to the fiber direction of the unidirectional fibers of adjacent layers. An example is a five layer article with the second, third, fourth and fifth layers rotated +45°, −45°, 90° and 0° with respect to the first layer, but not necessarily in that order. For the purposes of this invention, adjacent layers may be aligned at virtually any angle between about 0° and about 90° with respect to the longitudinal fiber direction of another layer. A preferred example includes two layers with a 0°/90° orientation. Such rotated unidirectional alignments are described, for example, in U.S. Pat. Nos. 4,457,985; 4,748,064; 4,916,000; 4,403,012; 4,623,573; and 4,737,402. The fiber networks can be constructed via a variety of well known methods, such as by the methods described in U.S. Pat. No. 6,642,159, which is incorporated herein by reference. It should be understood that the single-layer consolidated networks of the invention may generally include any number of cross-plied layers, such as about 2 to about 1500, more preferably from about 10 to 1000, and more preferably from about 20 to about 40 or more layers as may be desired for various applications.

In a particularly preferred embodiment of the invention, the fibers of the invention are first coated with an elastomeric matrix composition using one of the above techniques, followed by arranging a plurality of fibers into a non-woven fiber layer. Preferably, individual fibers are positioned next to and in contact with each other and are arranged into sheet-like arrays of fibers in which the fibers are aligned substantially parallel to one another along a common fiber direction. Conventional methods are preferably followed to form at least two unidirectional fiber layers whereby the fibers are substantially coated with the matrix composition on all fiber surfaces. Thereafter, the fiber layers are preferably consolidated into a single-layer consolidated fiber network. This may be achieved by stacking the individual fiber layers one on top of another, followed by bonding them together under heat and pressure to heat setting the overall structure, causing the matrix material to flow and occupy any remaining void spaces. As is conventionally known in the art, excellent ballistic resistance is achieved when individual fiber layer are cross-plied such that the fiber alignment direction of one layer is rotated at an angle with respect to the fiber alignment direction of another layer. For example, a preferred structure has two fiber layers of the invention positioned together such that the longitudinal fiber direction of one layer is perpendicular to the longitudinal fiber direction of the other layer.

In the most preferred embodiment, two layers of unidirectionally aligned fibers are cross-plied in the 0°/90° configuration and then molded to form a precursor. The two fiber layers can be continuously cross-plied, preferably by cutting one of the layers into lengths that can be placed successively across the width of the other layer in a 0°/90° orientation, forming what is known in the art as unitape. U.S. Pat. Nos. 5,173,138 and 5,766,725 describe apparatuses for continuous cross-plying. The resulting continuous two-ply structure can then be wound into a roll with a layer of separation material between each ply. When ready to form the end use structure, the roll is unwound and the separation material stripped away. The two-ply sub-assembly is then sliced into discrete sheets, stacked in multiple plies and then subjected to heat and pressure in order to form the finished shape and cure the matrix polymer, if necessary. Similarly, when a plurality of yarns are arranged to form a single layer, the yarns may be arranged unidirectionally and cross-plied in a similar fashion, followed by consolidation.

Suitable bonding conditions for consolidating the fiber layers into a single layer, consolidated network, or fabric composite, and attaching the optional polymer film layers include conventionally known lamination techniques. A typical lamination process includes pressing the cross-plied fiber layers together at about 110° C., under about 200 psi (1379 kPa) pressure for about 30 minutes. The consolidation of the fibers layers of the invention is preferably conducted at a temperature from about 200° F. (~93° C.) to about 350° F. (~177° C.), more preferably at a temperature from about 200° F. to about 300° F. (~149° C.) and most preferably at a temperature from about 200° F. to about 280° F. (~121° C.), and at a pressure from about 25 psi (~172 kPa) to about 500 psi (3447 kpa) or higher. The consolidation may be conducted in an autoclave, as is conventionally known in the art.

When heating, it is possible that the matrix can be caused to stick or flow without completely melting. However, generally, if the matrix material is caused to melt, relatively little pressure is required to form the composite, while if the matrix material is only heated to a sticking point, more pressure is typically required. The consolidation step may generally take from about 10 seconds to about 24 hours. However, the temperatures, pressures and times are generally dependent on the type of polymer, polymer content, process and type of fiber.

The thickness of the individual fabric layers will correspond to the thickness of the individual fibers. Accordingly, preferred single-layer, consolidated networks of the invention will have a preferred thickness of from about 25 μm to about 500 μm, more preferably from about 75 μm to about 385 μm and most preferably from about 125 μm to about 255 μm. While such thicknesses are preferred, it is to be understood that other film thicknesses may be produced to satisfy a particular need and yet fall within the scope of the present invention.

Following the consolidation of the fiber layers, a polymer layer is preferably attached to each of the anterior and posterior surfaces of the single-layer, consolidated network via conventional methods. When a stack of panels is formed, each individual panel of the stack preferably has a polymer layer attached to each of its anterior ant posterior surfaces. This polymer layer prevents the panels from sticking together prior to molding the panels of the stack together. Suitable polymers for said polymer layer non-exclusively include thermoplastic and thermosetting polymers. Suitable thermoplastic polymers non-exclusively may be selected from the group consisting of polyolefins, polyamides, polyesters, polyurethanes, vinyl polymers, fluoropolymers and co-polymers and mixtures thereof. Of these, polyolefin layers are preferred. The preferred polyolefin is a polyethylene. Non-limiting examples of polyethylene films are low density polyethylene (LDPE), linear low density polyethylene (LLDPE), linear medium density polyethylene (LMDPE), linear very-low density polyethylene (VLDPE), linear ultra-low density polyethylene (ULDPE), high density polyethylene (HDPE). Of these, the most preferred polyethylene is LLDPE. Suitable thermosetting polymers non-exclusively include thermoset allyls, aminos, cyanates, epoxies, phenolics, unsaturated polyesters, bismaleimides, rigid polyurethanes, silicones, vinyl esters and their copolymers and blends, such as those described in U.S. Pat. Nos. 6,846,758, 6,841,492 and 6,642,159. As described herein, a polymer film includes polymer coatings.

The polymer film layers are preferably attached to the single-layer, consolidated network using well known lamination techniques. Typically, laminating is done by positioning the individual layers on one another under conditions of sufficient heat and pressure to cause the layers to combine into a unitary film. The individual layers are positioned on one another, and the combination is then typically passed through the nip of a pair of heated laminating rollers by techniques well known in the art. Lamination heating may be done at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. In the preferred embodiment of the invention, the polymer film layers preferably comprise from about 2% to about 25% by weight of the overall panel, more preferably from about 2% to about 17% percent by weight of the overall panel and most preferably from 2% to 12%. The percent by weight of the polymer film layers will generally vary depending on the number of fabric layers forming the multilayered film. While the consolidation and outer polymer layer lamination steps are described herein as two separate steps, they may alternately be combined into a single consolidation/lamination step via conventional techniques in the art.

The polymer film layers are preferably very thin, having preferred layer thicknesses of from about 1 μm to about 250 μm, more preferably from about 5 μm to about 25 μm and most preferably from about 5 μm to about 9 μm. The thickness of the individual fabric layers will correspond to the thickness of the individual fibers. Accordingly, preferred single-layer, consolidated networks of the invention will have a preferred thickness of from about 25 μm to about 500 μm, more preferably from about 75 μm to about 385 μm and most preferably from about 125 μm to about 255 μm. While such thicknesses are preferred, it is to be understood that other film thicknesses may be produced to satisfy a particular need and yet fall within the scope of the present invention.

In accordance with the invention, the panel or stack of panels described herein is reinforced by at least one of various techniques. In one preferred embodiment, the panel or stack may be reinforced at one or more edges where fibers may have been trimmed or cut during manufacturing. For example, the panel or stack of panels may be reinforced by stitching at least one edge of one or more of said panels with a high strength thread, or by melting the edges of the panel or stack of panels to reinforce areas that may have been frayed during standard trimming procedures. Stitching and sewing methods are well known in the art, including methods such as lock stitching, hand stitching, multi-thread stitching, over-edge stitching, flat seam stitching, chain stitching, zig-zag stitching and the like. The type of thread used to stitch stitches employed in the preferred embodiments of the invention may vary widely, but preferably comprise threads of said high strength, high modulus fibers having a tenacity of about 7 g/denier or more and a tensile modulus of about 150 g/denier or more as described above, and more preferably comprise aramid or polyethylene fibers, most preferably comprising polyethylene. The threads may comprise mono or multifilament yarns, and most preferably are multifilament yarns, as described in U.S. Pat. No. 5,545,455, which is incorporated herein by reference in its entirety. The amount of stitches employed may vary widely. In general in penetration resistance applications, the amount of stitches employed is such that the stitches comprise less than about 10% of the total weight of the stitched fibrous layers. A single panel is preferably stitched through each of the layers of the consolidated network of fibers. A stack of panels may comprise multiple individually stitched panels or the entire stack may be stitched to join together each of discrete panel together.

Alternately, the panel or stack of panels may be reinforced by melting the edges of the one or more discrete panels, or by melting the edges of the entire stack of panels under heat and pressure. Edges may be melted, for example, using an edge mold or using a solid metal frame, e.g. a solid metal picture frame. The edge mold or solid metal frame can be heated using an oven or mounted in a press which has heating and cooling capability. The mold or metal frame will press and mold only the edges. Melting conditions, such as temperatures, pressures and duration, will be dependent on factors such as the number of fiber layers or panels and their thicknesses. Such conditions would be readily determined by one skilled in the art. A panel or stack may also be both stitched and melted at one or more edges.

In addition to stitching and/or melting the panel or stack, the panel or stack of panels may be reinforced by wrapping said one or more panels with one or more woven or non-woven fibrous wraps. In the preferred embodiment of the invention, the panel or stack of panels is reinforced with a first fibrous wrap which encircles at least a portion of said anterior surface, said posterior surface and at least one edge of said panel, or at least a portion of said top surface, said bottom surface and at least one edge of said stack. Additionally, a second fibrous wrap may optionally encircle the panel or stack of panels over the first fibrous wrap. As used herein, when it is described that a first fibrous wrap and optional second fibrous wrap "encircle" a stack of panels, each panel of said stack is considered to be encircled, even though only the outer surfaces of the top and bottom panels of the stack would be touching the wraps. In another embodiment of the invention, one or more additional fibrous wraps may further be wrapped around the panel or stack, encircling said first fibrous wrap and said second fibrous wrap. Generally, based on the ballistic threat and/or thickness and type of ceramic, more than two fibrous wraps can be used. Each additional fibrous wrap preferably encircles the panel or stack in a wrapping direction transverse to the wrapping direction of the nearest underlying fibrous wrap.

Each of the first and second fibrous wraps preferably comprise a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers. The wraps may be similar to, identical to, or different than the material which forms the panels, and may be the same as or different than each other.

In the preferred embodiment of the invention, both the first and second fibrous wraps are present and each are identical. Preferably, the wrapping material comprises coated SPECTRA® (HMPE) fibers, aramid fibers, PBO fibers, M5® fibers, E and S type fiberglass fibers, nylon fibers, polyester fibers, polypropylene fibers or natural fibers or a combination thereof. The wrapping material may further comprise SPECTRA® Shield, coated fabric, felt or a combination of fabric and felt. The fibrous wraps preferably comprise multilayer structures. Alternately, single coated fibers can be wrapped in all directions of the panels or other articles. In the preferred embodiment of the invention, each of the first and second wraps preferably comprise multiple layers of cross-plied layers of unidirectionally aligned fibers in an parallel array, and preferably encircle the panel or stack such that the encircling direction of the first wrap is at an angle to the encircling direction of the second wrap. Most preferably, the first fibrous wrap and second fibrous wrap encircle the panel or stack in perpendicular directions.

Generally, both said first fibrous wrap and said second fibrous wrap are preferably incorporated if the polymer layers are not incorporated. If the polymer layers are incorporated, wrapping is not necessarily required, as long as another form of reinforcement is used. In general, wrapping is not required when the edges are melted. When incorporated, the first fibrous wrap and optional second fibrous wrap should be wrapped around the panel or stack after the panel or stack is molded into a desired shape. Generally, single or multiple fibers, i.e. in form of a tape, can be wrapped on any shape article. The wrapping is preferably conduced using methods that would be readily understood by one skilled in the art, such as with filament winding machines for flat and symmetric pipe type articles, or polar winding machines for missiles and other conical or non symmetric shapes.

The first fibrous wrap and optional second fibrous wrap can be wound around the panel or stack and maintained in place by tension, or may be attached to the panel (or top panel of the stack) by suitable attaching means, for example, with adhesives such as polysulfides, epoxies, phenolics, elastomers, and the like, or via mechanical means, such as staples, rivets, bolts, screws or the like. Optionally, the ballistic resistant panel or stack of panels may be both stitched and wrapped, wherein the stitches are threaded through the first fibrous wrap and optional second fibrous wrap. The ballistic resistant panel or stack may also optionally have both reinforced, melted edges and be subsequently wrapped with said first wrap and optional second wrap. 26. Further, after wrapping, the panel (or stack), said first fibrous wrap and said optional second fibrous wrap are preferably united by consolidation. For example, after wrapping, a 4-panel stack is preferably transferred into a sealable bag and a vacuum applied. The bag under vacuum is then preferably transferred to an autoclave where heat (240° F.) and pressure (100 psi) (689.5 kpa) are applied, followed by cooling to room temperature.

In another embodiment, the invention also provides one or more ballistic resistant panels including at least one rigid plate attached thereto for improving ballistic resistance performance, which may also be reinforced with one or more of the aforementioned techniques. Such a rigid plate may comprise a ceramic, a glass, a metal-filled composite, a ceramic-filled composite, a glass-filled composite, a cermet, high hardness steel (HHS), armor aluminum alloy, titanium or a combination thereof, wherein the rigid plate and the inventive panels are stacked together in face-to-face relationship. If a stack of multiple discrete panels is formed, only one rigid plate is preferably attached to the top surface of the overall stack, rather than to each individual panel of the stack. Three most preferred types of ceramics include aluminum oxide, silicon carbide and boron carbide. The ballistic panels of the invention may incorporate a single monolithic ceramic plate, or may comprise small tiles or ceramic balls suspended in flexible resin, such as a polyurethane. Suitable resins are well known in the art. Additionally, multiple layers or rows of tiles may be attached to the plates of the invention. For example, multiple 3"×3"×0.1" (7.62 cm×7.62 cm×0.254 cm) ceramic tiles may be mounted on a 12"×12" (30.48 cm×30.48 cm) panel using a thin polyurethane adhesive film, preferably with all ceramic tiles being lined up with such that no gap is present between tiles. A second row of tiles may then be attached to the first row of ceramic, with an offset so that joints are scattered. This continues all the way down to cover the entire armor. In general, wrapping is not required when the ceramic plate is present, but it is preferred. For high performance at the lowest weight, it is preferred to mold the panels or stack at high pressure before attaching the rigid plate. However, for large panels, e.g. 4'×6' (1.219 m×1.829 m) or 4'×8' (1.219 m×2.438 m), the panel or stack and rigid plate may be molded in a single, low pressure autoclave process.

After formation of the delamination resistant, ballistic resistant fabrics of the invention, they may be used in various applications. The fabric composites of the present invention are particularly useful for the formation of delamination resistant, ballistic resistant "hard" armor articles. By "hard" armor is meant an article, such as helmets, protective plates or panels for military vehicles, or protective shields, which have sufficient mechanical strength so that it maintains structural rigidity when subjected to a significant amount of stress and is capable of being freestanding without collapsing.

The delamination resistant, ballistic resistant materials, or fabric composites, of the invention may be molded into articles by subjecting the panel or the stack of panels to heat and pressure. The temperatures and/or pressures to which one or more sheets of said single layer, consolidated network of fibers are exposed for molding vary depending upon the type of high strength fiber used. For example, armor panels can be made by molding a stack of said sheets under a pressure of about 150 to about 400 psi (1,030 to 2,760 kPa) preferably about 180 to about 250 psi (1,240 to 1,720 kPa) and a temperature of about 104° C. to about 127° C. Helmets can be made by molding a stack of said sheets under a pressure of about 1500 to about 3000 psi (10.3 to 20.6 MPa) and a temperature of about 104° C. to about 127° C. Generally, molding temperatures may range from about 20° C. to about 175° C., preferably from about 100° C. to about 150° C., more preferably from about 110° C. to about 130° C. Also suitable are the techniques suitable for forming articles described in, for example, U.S. Pat. Nos. 4,623,574, 4,650,710, 4,748,064, 5,552,208, 5,587,230, 6,642,159, 6,841,492 and 6,846,758. Molded protective plates may also be made via conventionally known techniques and conditions.

Garments of the invention may be formed through methods conventionally known in the art. Preferably, a garment may be formed by adjoining the delamination resistant fabrics of the invention with an article of clothing. For example, a vest may comprise a generic fabric vest that is adjoined with the delamination resistant fabrics of the invention, whereby one or more of the inventive fabrics are inserted into strategically placed pockets. This allows for the maximization of ballistic protection, while minimizing the weight of the vest. As used herein, the terms "adjoining" or "adjoined" are intended to include attaching, such as by sewing or adhering and the like, as well as un-attached coupling or juxtaposition with another fabric, such that the delamination resistant, ballistic resistant fabrics may optionally be easily removable from the vest or other article of clothing. Fabrics used in forming flexible structures like flexible sheets, vests and other garments are preferably formed from fabrics using a low tensile modulus matrix composition. Hard articles like helmets and armor are preferably formed from fabrics using a high tensile modulus matrix composition.

The ballistic resistance properties are determined using standard testing procedures that are well known in the art. For example, screening studies of ballistic composites commonly employ a 22 caliber, non-deforming steel fragment of specified weight, hardness and dimensions (Mil-Spec.MIL-P-46593A(ORD)). Testing may also be conduced with AK 47 bullets (7.62 mm×39 mm) with mild steel pin penetrator (weight: 123 grain) following MIL-STD-662F standard procedures, particularly for setting up a firing barrel, velocity measuring screens and mounting the molded panel for testing.

The protective power or penetration resistance of a structure is normally expressed by citing the impacting velocity at which 50% of the projectiles penetrate the composite while 50% are stopped by the shield, also known as the $V_{50}$ value. As used herein, the "penetration resistance" of the article is the resistance to penetration by a designated threat, such as physical objects including bullets, fragments, shrapnels and the like, and non-physical objects, such as a blast from explosion. For composites of equal areal density, which is the weight of the composite panel divided by the surface area, the higher the $V_{50}$, the better the resistance of the composite. The ballistic resistant properties of the fabrics of the invention will vary depending on many factors, particularly the type of fibers used to manufacture the fabrics.

The fabrics of the invention also exhibit good peel strength. Peel strength is an indicator of bond strength between fiber layers. As a general rule, the lower the matrix polymer content, the lower the bond strength. However, below a critical bond strength, the ballistic material loses durability during material cutting and assembly of articles, such as a vest, and also results in reduced long term durability of the articles. In the preferred embodiment, the peel strength for SPECTRA® fiber materials in a SPECTRA® Shield (0°,90°) configuration is preferably at least about 0.17 lb/ft$^2$ (0.83 kg/m$^2$) good fragment resistance, more preferably at least about 0.188 lb/ft$^2$ (0.918 kg/m$^2$) and more preferably at least about 0.206 lb/ft$^2$ (1.006 kg/m$^2$).

The following non-limiting examples serve to illustrate the invention:

EXAMPLE 1

A control, 12"×12" (30.48 cm×30.48 cm) test panel was molded under heat and pressure by stacking 68 layers of SPECTRA® Shield following a 0°, 90° alternating fiber orientation. The molding process included preheating the stack of material for 10 minutes at 240° F. (115.6° C.), followed by applying 500 psi (3447 kPa) molding pressure for 10 minutes in a mold kept at 240° F. After 10 minutes, a cool down cycle was started and the molded panel was pulled out of the mold once the panel reached 150° F. (65.56° C.). The panel was further cooled down to room temperature without any external molding pressure.

For testing, MIL-STD-662F standard procedures were followed for setting up a firing barrel, velocity measuring screens and mounting the molded panel for testing. An AK 47 bullet (7.62 mm×39 mm) with mild steel pin penetrator (weight: 123 grain) was selected for measuring the ballistic resistance of the panel. Several AK 47 bullets were fired on the panel to measure the $V_{50}$, wherein $V_{50}$ is the velocity at which 50% of bullets will stop and 50% of bullets will penetrate the panel within a 125 fps (feet per second) (38.1 m/sec) velocity spread. Care was taken not to shoot the panel at least two inches from any of the clamped edges.

The panel started showing severe delamination and separation of layers after the first bullet was fired onto the panel. Care was taken to shoot the next bullet in an area which was not delaminated. After the test was completed, the panel was examined for the failure and delamination mode.

EXAMPLE 2

Four 12"×12" panels were molded under heat and pressure. Each panel consisted of 17 layers of SPECTRA® Shield, stacked and sandwiched between thin sheets of LLDPE film following a 0°, 90° alternating fiber orientation. The molding process included preheating each stack of material for 10 minutes at 240° F., followed by applying 500 psi molding pressure for 10 minutes in a mold kept at 240° F. After 10 minutes, a cool down cycle was started and the molded panels were pulled out of their molds once the panels reached 150° F. The panels were further cooled down to room temperature without any external molding pressure.

The four molded panels were stacked over each other and wrapped with four layers of SPECTRA® Shield. The first layer was wrapped from side-to-side followed by another wrapping layer in a transverse top to bottom direction of the panel, followed by wrapping again from side-to-side, followed by wrapping another layer from the top to the bottom of the panel. After wrapping, the 4-panel stack was transferred into a sealable bag and a vacuum was applied. The bag under vacuum was transferred to an autoclave where heat (240° F.) and pressure (100 psi) were applied for 30 minutes followed by a cool down cycle. Once the 4-panel stack reached room temperature, it was pulled out from the autoclave and removed from the bag.

For testing, MIL-STD-662F standard procedures were followed for setting up the firing barrel, velocity measuring screens and mounting the wrapped 4-panel stack for testing. Similar to Example 1, an AK 47 bullet was selected for measuring the ballistic resistance of the fully wrapped 4-panel stack. Several bullets were fired on the panel to measure the $V_{50}$. Care was taken not to shoot the panel at least two inches from any of the clamped edges.

The panel did not show severe delamination or separation of layers after firing several bullets onto the panel.

EXAMPLE 3

A control 12"×12" test panel was molded under heat and pressure by stacking 40 layers of SPECTRA® Shield following a 0°, 90° alternating fiber orientation. The molding process included preheating the stack of material for 10 minutes at 240° F., followed by applying 500 psi molding pressure for 10 minutes in a mold kept at 240° F. After 10 minutes, a cool down cycle was started and the molded panel was pulled out of the mold once the panel reached 150° F. The panel was further cooled down to room temperature without any external pressure.

Next, 3"×3"×0.1" (7.62 cm×7.62 cm×0.254 cm) ceramic tiles were mounted on the panel using a thin polyurethane adhesive film. Care was taken that all ceramic tiles were lined up with each other, touching adjacent tiles completely with no gap between tiles. Next, a row of tiles was installed in a similar manner, but with a 1.5" offset so that joints are scattered in comparison to the previous row of ceramic tiles.

For testing, MIL-STD-662F standard procedures were followed for setting up the firing barrel, velocity measuring screens and mounting the molded panel for testing. Similar to Example 1, an AK 47 bullet was selected for measuring the ballistic resistance of the panel. Several bullets were fired on the panel with the ceramic tiles facing the bullets. The $V_{50}$ was measured on the panel. Care was taken not to shoot the panel at least two inches from any of the clamped edges.

The panel started showing severe delamination and separation of layers after the first bullet was fired onto the panel. Care was taken to shoot the next bullet in an area which was not delaminated. After the test was completed, the panel was examined for the failure and delamination mode.

EXAMPLE 4

Four 12"×12" panels were molded under heat and pressure. Each panel consisted of 10 layers of SPECTRA® Shield, stacked and sandwiched between thin sheets of LLDPE film following a 0°, 90° alternating fiber orientation. The molding process included preheating the each stack of material for 10 minutes at 240° F., followed by applying 500 psi molding pressure for 10 minutes in a mold kept at 240° F. After 10 minutes, a cool down cycle was started and the molded panels were pulled out of their molds once the panels reached 150° F. The panels were further cooled down to room temperature without any external molding pressure.

The four molded panels were stacked over each other and 3"×3"×0.1" ceramic tiles were mounted on the assembled panel using a thin polyurethane adhesive film. Care was taken that all ceramic tiles in lined with each other, touching adjacent tiles completely with no gap between tiles. Next, a row of tiles was installed in a similar manner, but with a 1.5" 93.81 cm) offset so that joints are scattered in comparison to the previous row of ceramic tiles.

The assembled panel with ceramic was wrapped by four layers of SPECTRAL® Shield. The first layer was wrapped from side-to-side followed by another wrapping layer in a transverse top to bottom direction of the panel, followed by wrapping again from side-to-side, followed by wrapping another layer from the top to the bottom of the panel. After wrapping, the 4-panel stack was transferred into a sealable bag and a vacuum was applied. The bag under vacuum was transferred to an autoclave where heat (240° F.) and pressure (100 psi) were applied for 30 minutes followed by a cool down cycle. Once the 4-panel stack reached room temperature, it was pulled out from the autoclave and removed from the bag.

For testing, MIL-STD-662F standard procedures were followed for setting up the firing barrel, velocity measuring screens and mounting the wrapped 4-panel stack for testing. Similar to Example 1, an AK 47 bullet was selected for measuring the ballistic resistance of the fully wrapped panel. Several bullets were fired on the panel with ceramic facing the bullets, and the $V_{50}$ was measured. Care was taken not to shoot the panel at least two inches from any of the clamped edges.

The panel showed no separation of layers after several AK 47 bullets were fired on the panel.

The results from the above Examples are summarized in Table 1 below:

TABLE 1

| Example | Material | Wrapping | Areal Density (psf) (lb/ft$^2$) | V50 (fps) | Comment |
|---|---|---|---|---|---|
| 1 | One Molded Panel: 68 layers of SPECTRA ® Shield | No | 3.5 (17.09 kg/m$^2$) | 2022 (616.3 m/sec) | Delaminated after first shot |
| 2 | Four Molded Panels, each 17 layers of SPECTRA ® Shield | Yes | 3.6 (17.57 kg/m$^2$) | 1980 (603.5 m/sec) | Panel holding after 5 hits |
| 3 | One Molded Panel: 40 layers of SPECTRA ® Shield, 3" × 3" × 0.1" Ceramic Tiles | No | 3.95 (19.28 kg/m$^2$) | 1930 (588.3 m/sec) | Delaminated after first shot |
| 4 | Four Molded Panels, each 10 layers of SPECTRA ® Shield, 3" × 3" × 0.1" Ceramic Tiles | Yes | 4.05 (19.77 kg/m$^2$) | 2342 (713.8 m/sec) | Panel holding after 4 hits |

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant material comprising:

a) a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) at least one rigid plate attached to the anterior surface of said panel;

c) a first fibrous wrap encircling the panel and the at least one rigid plate, said first fibrous wrap encircling at least a portion of said anterior surface, said posterior surface and at least one edge of said panel, and which first fibrous wrap comprises a woven or non-woven fabric; and d) a second fibrous wrap encircling the panel and the at least one rigid plate, the second fibrous wrap encircling the first fibrous wrap in a direction transverse to the encircling direction of the first fibrous wrap, and which second fibrous wrap comprises a woven or non-woven fabric.

2. The ballistic resistant material of claim 1 further comprising at least one layer of a polymer film attached to each of said anterior and posterior surfaces of said consolidated network of fibers.

3. The ballistic resistant material of claim 1 which comprises a plurality of discrete panels arranged in a stack, which stack has a top surface, a bottom surface and one or more edges; which at least one rigid plate is attached to the top surface of said stack, and which first fibrous wrap and optional second fibrous wrap encircle the at least one rigid plate and at least a portion of said top surface, said bottom surface and at least one edge of said stack.

4. The ballistic resistant material of claim 1 wherein at least one edge of said panel is reinforced.

5. The ballistic resistant material of claim 1 wherein at least one edge of said panel is reinforced by stitching said panel at said at least one edge.

6. The ballistic resistant material of claim 1 wherein at least one edge of said panel is at least partially frayed, and wherein said at least partially frayed edge is reinforced by melting at least a portion of said panel at said at least one at least partially frayed edge, where melt reinforcement occurs only at said at least one at least partially frayed edge.

7. A ballistic resistant article formed from the ballistic resistant material of claim 1.

8. A ballistic resistant article formed from the ballistic resistant material of claim 3.

9. The ballistic resistant material of claim 1 wherein said at least one rigid plate comprises a ceramic, a glass, a metal-filled composite, a ceramic-filled composite, a glass-filled composite, a cermet, high hardness steel, armor aluminum alloy, titanium or a combination thereof.

10. A method of producing a ballistic resistant material comprising:

a) forming at least one panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) molding the panel into an article;

c) encircling a first fibrous wrap around the molded panel, said first fibrous wrap encircling at least a portion of said anterior surface, said posterior surface and at least one edge of said panel, and which first fibrous wrap comprises a woven or non-woven fabric; and d) encircling a second fibrous wrap around the molded panel, the second fibrous wrap encircling the first fibrous wrap in a direction transverse to the encircling direction of the first fibrous wrap, and which second fibrous wrap comprises a woven or non-woven fabric.

11. The, method of claim 10 further comprising reinforcing at least one edge of said panel.

12. The method of claim 10 further comprising forming a stack of a plurality of discrete panels, which stack has a top surface, a bottom surface and one or more edges; which stack is molded and encircled with said first fibrous wrap and second fibrous wrap around at least a portion of said top surface, said bottom surface and at least one edge of said stack.

13. A method of producing a ballistic resistant material comprising:

a) forming a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) molding the panel;

c) attaching at least one rigid plate to the anterior surface of said molded panel;

d) encircling a first fibrous wrap around the molded panel and the at least one rigid plate, said first fibrous wrap encircling at least a portion of said anterior surface, said posterior surface and at least one edge of said panel, and which first fibrous wrap comprises a woven or non-woven fabric; and e) encircling a second fibrous wrap around the molded panel and the at least one rigid plate, the second fibrous wrap encircling the first fibrous wrap in a direction transverse to the encircling direction of the first fibrous wrap, and which second fibrous wrap comprises a woven or non-woven fabric.

14. The method of claim 13 further comprising at least one layer of a polymer film attached to each of said anterior and posterior surfaces of said consolidated network of fibers.

15. The method of claim 13 further comprising reinforcing at least one edge of said panel.

16. The method of claim 13 further comprising forming a stack of a plurality of discrete panels, which stack has a top surface, a bottom surface and one or more edges, wherein the at least one rigid plate is attached to at least one panel of said stack, and encircling said first fibrous wrap and optional second fibrous wrap around at least a portion of said at least one rigid plate and at least a portion of said top surface, said bottom surface and at least one edge of said stack.

17. The method of claim 13 wherein said at least one rigid plate comprises a ceramic, a glass, a metal-filled composite, a ceramic-filled composite, a glass-filled composite, a cermet, high hardness steel, armor aluminum alloy, titanium or a combination thereof.

18. A ballistic resistant material comprising:

a) a panel having an anterior surface, a posterior surface and one or more edges, which panel comprises:

i) a consolidated network of fibers, the consolidated network of fibers comprising a plurality of non-woven cross-plied fiber layers, each fiber layer comprising a plurality of fibers arranged in an array; each of said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers; and iii) wherein one or more edges of said panel are at least partially frayed, and wherein said one or more at least partially frayed edges are reinforced by melting at least a portion of said panel at said one or more at least partially frayed edges, and where melt reinforcement occurs only at said one or more at least partially frayed edges;

b) an optional first fibrous wrap encircling the panel, said first fibrous wrap encircling at least a portion of said anterior surface, said posterior surface and at least one edge of said panel, and which first fibrous wrap comprises a woven or non-woven fabric; and c) an optional second fibrous wrap encircling the panel, the second fibrous wrap encircling the first fibrous wrap in a direction transverse to the encircling direction of the first fibrous wrap, and which second fibrous wrap comprises a woven or non-woven fabric.

19. The ballistic resistant material of claim 18 which comprises a plurality of discrete panels arranged in a stack, which stack has a top surface, a bottom surface and one or more edges, wherein said one or more edges of said stack are at least partially frayed, and wherein said one or more at least partially frayed edges are reinforced by melting at least a portion of said stack at said one or more at least partially frayed edges, where melt reinforcement occurs only at said one or more at least partially frayed edges.

20. A ballistic resistant article formed from the ballistic resistant material of claim 18.

21. A ballistic resistant article formed from the ballistic resistant material of claim 19.

22. The ballistic resistant material of claim 18 wherein said at least one layer of a polymer film is present.

23. The ballistic resistant material of claim 18 wherein said first fibrous wrap and said second fibrous wrap are both present.

24. A ballistic resistant material comprising:

a) a panel having an anterior surface, a posterior surface and one or more edges, which panel comprises:

i) a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers; and ii) optionally at least one layer of a polymer film attached to each of said anterior and posterior surfaces of said consolidated network of fibers;

b) a first fibrous wrap encircling the panel, said first fibrous wrap encircling at least a portion of said anterior surface, said posterior surface and at least one edge of said panel, and which first fibrous wrap comprises a woven or non-woven fabric; and c) a second fibrous wrap encircling the panel, the second fibrous wrap encircling the first fibrous wrap in a direction transverse to the encircling direction of the first fibrous wrap, and which second fibrous wrap comprises a woven or non-woven fabric.

25. A ballistic resistant article formed from the ballistic resistant material of claim 24.

26. The ballistic resistant material of claim 24 wherein said at least one layer of a polymer film is present.

27. The ballistic resistant material of claim 24 which comprises a second fibrous wrap encircling the panel, which second fibrous wrap encircles the panel in a direction transverse to the direction of said first fibrous wrap, and which second fibrous wrap comprises a woven or non-woven fabric.

28. The ballistic resistant material of claim 24 wherein said first fibrous wrap and said second fibrous wrap each comprise a consolidated network of fibers, the consolidated network of fibers comprising a plurality of cross-plied fiber layers, each fiber layer comprising a plurality of fibers arranged in an array; said fibers having a tenacity of about 7 g/denier or more and a tensile modulus of about 150 g/denier or more; said fibers having a matrix composition thereon; the plurality of cross-plied fiber layers being consolidated with said matrix composition to form the consolidated network of fibers.

29. The ballistic resistant material of claim 24 wherein said panel comprises a consolidated network of fibers which consolidated network of fibers comprises a plurality of cross-plied fiber layers, each fiber layer comprising a plurality of fibers arranged in a substantially parallel array.

30. The ballistic resistant material of claim 24 which comprises a plurality of discrete panels arranged in a stack, which stack has a top surface, a bottom surface and one or more edges, and which first fibrous wrap and second fibrous wrap encircle at least a portion of said top surface, said bottom surface and at least one edge of said stack.

31. The ballistic resistant material of claim 24 wherein at least one edge of said panel is reinforced.

32. The ballistic resistant material of claim 24 wherein each edge of said panel is reinforced by stitching said panel at each with at least one thread, which thread comprises high strength fibers having a tenacity of about 7 g/denier or more and a tensile modulus of about 150 g/denier or more.

33. The ballistic resistant material of claim 30 wherein at least one edge of said stack is reinforced.

34. The ballistic resistant material of claim 30 wherein each edge of said stack is reinforced by stitching said stack at each edge with at least one thread, which thread comprises high strength fibers having a tenacity of about 7 g/denier or more and a tensile modulus of about 150 g/denier or more.

35. The ballistic resistant material of claim 24 wherein said fibers comprise a material selected from the group consisting of extended chain polyolefin fibers, aramid fibers, polybenzazole fibers, polyvinyl alcohol fibers, polyamide fibers, polyethylene terephthalate fibers, polyethylene naphthalate fibers, polyacrylonitrile fibers, liquid crystal copolyester fibers, glass fibers and carbon fibers.

36. The ballistic resistant material of claim 24 wherein said fibers comprise polyethylene fibers.

37. The ballistic resistant material of claim 24 wherein said matrix composition comprises an elastomeric composition.

38. The ballistic resistant material of claim 24 wherein said matrix composition comprises a thermosetting composition.

39. The ballistic resistant material of claim 24 wherein the matrix composition comprises polystyrene-polyisoprene-polystrene-block copolymer.

40. The ballistic resistant material of claim 24 wherein each of said fiber layers are cross-plied at a 90° angle relative to the longitudinal fiber direction of each adjacent fiber layer.

41. A ballistic resistant article formed from the ballistic resistant material of claim 24.

42. A ballistic resistant article formed from the ballistic resistant material of claim 30.

43. A ballistic resistant article formed from the ballistic resistant material of claim 31.

44. A ballistic resistant article formed from the ballistic resistant material of claim 33.

45. The ballistic resistant material of claim 26 wherein said polymer film comprises a polyolefin, polyamide, polyester, polyurethane, vinyl polymer, fluoropolymer or a copolymer or combination thereof.

46. The ballistic resistant material of claim 26 wherein said polymer film comprises linear low density polyethylene.

* * * * *